US006155939A

United States Patent [19]

Takacs

[11] Patent Number: 6,155,939

[45] Date of Patent: Dec. 5, 2000

[54] GAMEBOARD, ESPECIALLY TABLEBOARD FOR BALL GAMES

[76] Inventor: Andrew Takacs, 99 Farms Road Cir., East Brunswick, N.J. 08816

[21] Appl. No.: 09/011,441

[22] PCT Filed: Aug. 22, 1996

[86] PCT No.: PCT/IB96/00953

§ 371 Date: Aug. 4, 1998

§ 102(e) Date: Aug. 4, 1998

[87] PCT Pub. No.: WO97/07863

PCT Pub. Date: Mar. 6, 1997

[30] Foreign Application Priority Data

Aug. 25, 1995 [HU] Hungary ..... 9502498

[51] Int. Cl.[7] ..... A63B 67/04; A63B 71/04

[52] U.S. Cl. ..... 473/496; 473/475; 473/473

[58] Field of Search ..... 473/496, 465, 473/475, 415, 473, 474, 459

[56] References Cited

U.S. PATENT DOCUMENTS

| | | | |
|---|---|---|---|
| 2,161,463 | 6/1939 | Frost . | |
| 2,313,701 | 3/1943 | White | 473/475 |
| 4,030,734 | 6/1977 | Castellucci | 473/475 |
| 4,039,187 | 8/1977 | Shea | 473/415 |
| 4,334,681 | 6/1982 | Scheie | 473/465 |
| 4,345,758 | 8/1982 | Kempf | 473/475 |
| 4,521,017 | 6/1985 | McCready | 473/459 |
| 4,765,619 | 8/1988 | Cooper | 473/496 |
| 4,772,018 | 9/1988 | Inniger | 473/475 |
| 5,470,057 | 11/1995 | Bodford | 473/417 |
| 5,575,471 | 11/1996 | Robinson et al. | 473/475 |
| 5,733,211 | 3/1998 | Dupre | 473/496 |

FOREIGN PATENT DOCUMENTS 2606653 5/1988 France .

OTHER PUBLICATIONS

Abstract of Russian Patents of RU 2029582 —Feb. 15, 1995.

*Primary Examiner*—Jeanette Chapman
*Assistant Examiner*—M. Chambers
*Attorney, Agent, or Firm*—Ladas & Parry

[57] ABSTRACT

The present invention concerns a gameboard, especially for playing table ball games, e.g. table tennis, having a playing surface which touches the ball during play and a support base supporting the playing surface and placed on the floor.

Gameboard characterized by that the support base (1) is formed as a frame-like support base (1), and having an open play field (13) formed by three playing surfaces (8,9,10), which playing surfaces (8,9,10) are supported by the support base (1).

21 Claims, 2 Drawing Sheets

GAMEBOARD, ESPECIALLY TABLEBOARD FOR BALL GAMES

TECHNICAL FIELD

The present invention concerns a gameboard, especially for playing table ball games, e.g. table tennis, having a playing surface which touches the ball during play and a support base supporting the playing surface and placed on the floor.

PRIOR ART

Traditional table ball games require relatively large play area, and therefor these games can not be played in smaller rooms or other places with a limited space. Numerous solutions have been suggested with the aim of creating versions of popular ball games that require only a small space to play. In most cases these games are only miniaturised versions of the traditional table ball games.

Such games are described in the U.S. Pat. No. 4,722,018, U.S. Pat. No. 4,765,618, U.S. Pat. No. 4,334,681, U.S. Pat. No. 3,066,724, U.S. Pat. No. 4,030,734 and U.S. Pat. No. 3,891,210 patent specifications, and in the RU 2029582 patent specification.

A common disadvantage of the suggested solutions that they do not meet the demands raised by the modern age.

U.S. Pat. No. 4,030,734 (Castellucci) teaches a table game with a substantially horizontal playing surface with a supplemental rebounding surface suspended above the horizontal playing surfaces. Alternatively, the supplemental rebounding surface is constructed of two half plates, which are at an angle, the playing surfaces facing away from each other. The table game allows playing for two players placed on the opposite sides of the table. It is a disadvantage of this known solution that while the trajectory of the ball is confined to the space between the play surfaces, the overall area required to play the game is still relatively large, because the route of the ball is essentially straight, and hence there is a minimum of length that the ball must travel before its trajectory is sensed and appreciated by the opposing player.

U.S. Pat. No. 4,334,681 discloses a table game, in which the players utilise a table having three playing surfaces, with an angle at each other within a specified range. One playing surface is essentially vertical, while an upper playing surface is forming an angle of approximately 115°–135° with the vertical surface, and a lower playing surface is forming an angle of approximately 95°–105° with the vertical surface. With this table the trajectory of the ball is shortened, because the ball has to rebound between the upper and lower surfaces, and thus the overall area required to play with the table game is substantially reduced. However, the players must be on the same side of the table, and therefore unavoidably hinder each other's play.

RU 2029582 teaches a conventional table tennis table, supplied with a tunnel-like upper playing surface, covering the middle part of the table. The tunnel has a top part and oblique and vertical side parts (edge faces). The play is made more difficult by the ball rebounding from the oblique side parts of the covering tunnel, and being invisible on this part of the trajectory. The game is thereby more complicated, but difficult to watch by spectators, and essentially the same area is needed to play as for ordinary table-tennis.

It is the object of the present invention to provide a game that requires fast play, hard exercise and increased rate of movement, but at the same time needs little play space, and may be played preferably in any apartment, and provides good entertainment and exercise.

SUMMARY OF THE INVENTION

According to the invention, the object is realised with a gameboard having two lower playing surfaces and positioned above the lower playing surfaces one upper playing surface substantially parallel to the floor and the upper playing surface facing down and towards the lower playing surfaces. The playing surfaces are being disposed at an angle with each other, in order to touch the ball during play. The gameboard is further having support base means supporting the playing surfaces, and an open play field formed by the three playing surfaces. According to the invention, the gameboard comprises two equal sized lower playing surfaces arranged in a V-shape, with the playing surfaces of the lower playing surface parts facing up and tilted toward each other, and inclining to the horizontal plane with equal angles.

In a preferred embodiment, the lower playing surfaces arranged in V-shape are inclined with respect to the floor surface with an angle of 22–32 degrees.

In a further preferred embodiment, the support base comprises a horizontal foot part resting on the floor surface, and further comprises lower and upper leg parts perpendicular to the foot parts, said leg parts supporting the playing surfaces and being connected to the foot part and being connected with each other with upper and lower crossbars supporting the playing surfaces, and the crossbars being parallel with the surface of the floor, and farther comprises connecting braces between the lower legs, said braces being connected to the lower crossbar. The lower playing surfaces arranged in V-shape are fixedly connected to the crossbar. Alternatively, the lower playing surfaces arranged in V-shape are formed in a foldable manner.

According to a further embodiment of the invention, the gameboard further comprises support elements connecting the lower playing surfaces arranged in V-shape to the upper leg parts.

In an other preferred embodiment, the playing surfaces are adjustable into a vertical position relative to the plane of the floor. Also, the support base may be provided with adjustment means adjusting the upper playing surface in a direction parallel with the floor.

According to the invention, it is further foreseen that the gameboard comprises a net limiting the play field from the side of the leg parts.

In every preferred embodiment, the playing surfaces are provided with different markings, preferably with colour markings.

BRIEF DESCRIPTION OF DRAWINGS

By way of example only, an embodiment of the invention will now be described with reference to the accompanying drawings, in which.

BEST MODE FOR CARRYING OUT THE INVENTION

The gameboard of the invention is essentially a means for playing a table ball game.

Figure 1:
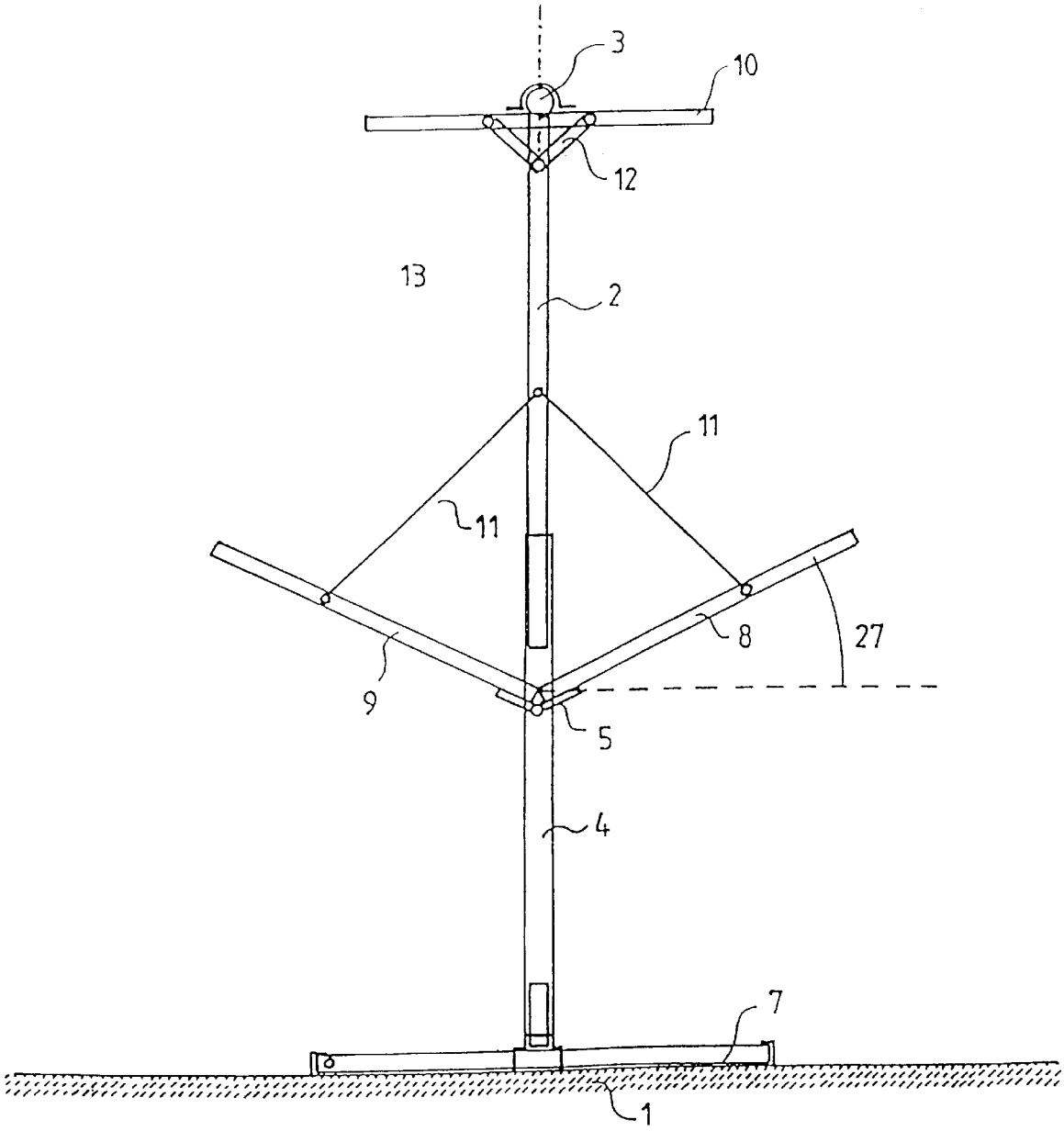
FIG. 1 is a side view of the gameboard of the invention.
Figure 2:
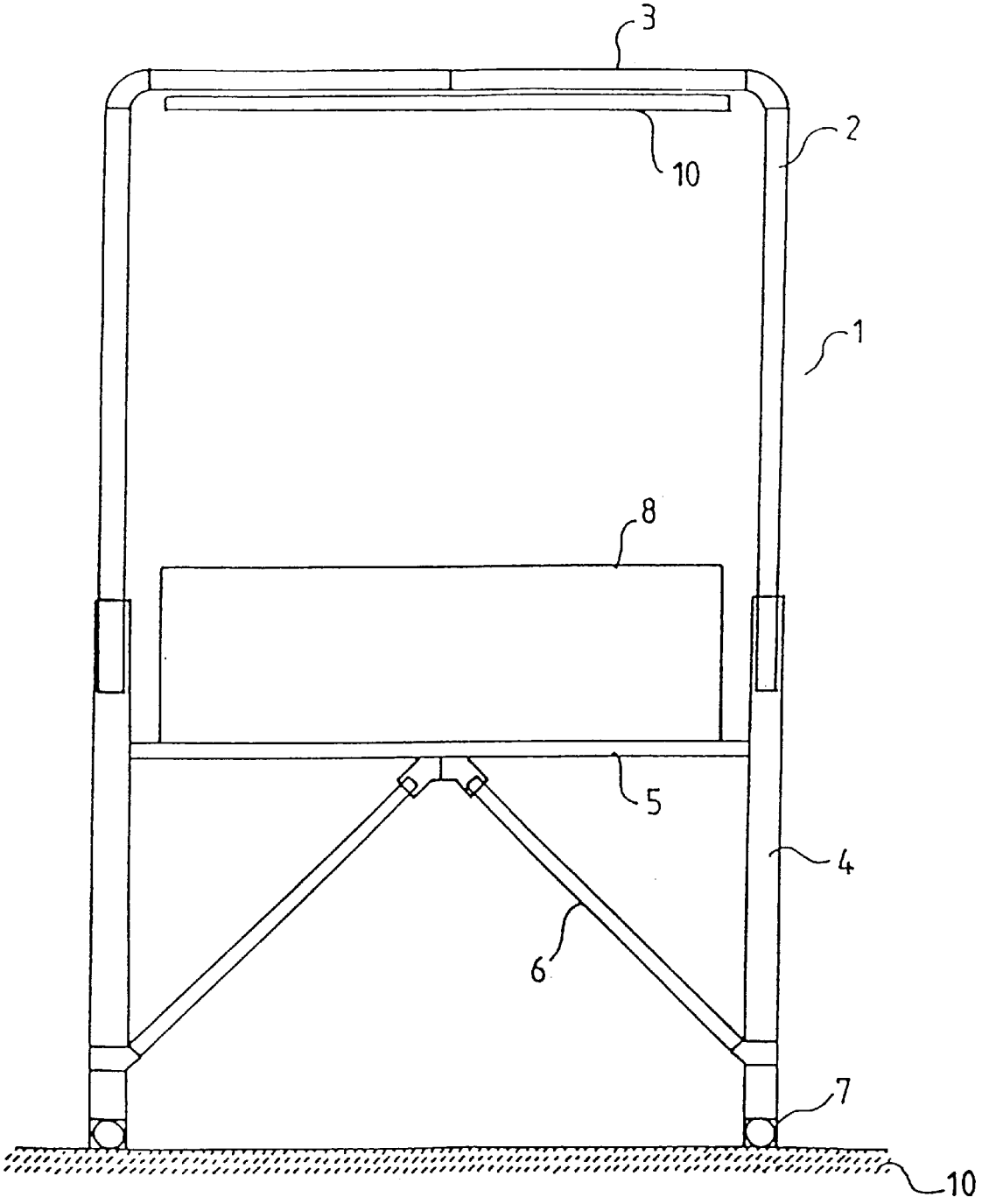
FIG. 2 is a front view of the gameboard of FIG. 1.

The gameboard has a support base or support frame 1, which support frame 1 comprises a horizontal foot part 7 resting on the floor surface 14, and further comprises lower leg parts 2 and upper leg parts 4 perpendicular to the foot parts 7. The support frame supports the playing surfaces 8,9,10. The playing surfaces 8,9,10 partly limit the playing field 13. The playing surfaces 8 and 9 have an equal size, while the size of the upper playing surface 10 may have a different size. The support frame 1 further comprises connecting braces 6 between the lower legs 4 and the lower crossbar 5 connecting the lower legs 4. The braces 6 increase the stability of the gameboard of the invention (see FIG. 2.) The playing surfaces 8 and 9 are fixed to the crossbar 5 of the support frame 1, and arranged in a V-shape. The fixing of the playing surfaces 8 and 9 arranged in a V-shape may be a rigid fixation. In this case the playing surfaces 8 and 9 are always fixed in a given position. Alternatively, the fixation may be with a hinge or joint, and thus the playing surfaces 8 and 9 may be moved out of the V-shape, and closed towards each other. The playing surfaces 8 and 9 are inclined with respect to the floor surface 14 with an angle of 22–32 degrees, in the present embodiment 27 degrees. The playing surfaces 8 and 9 are further locked in position through support elements 11 connected to the side of the lower playing surfaces 8 and 9 and to the upper leg parts 2 of the support frame 1. A wooden plate constituting the upper playing surface 10 is connected to the lower part of the upper crossbar 3 connecting the upper leg parts 2 and arranged parallel to the floor. The lower leg parts 4 connected to the foot parts 7 of the support frame 1 are movable in a direction perpendicular to the foot parts 7 with a predetermined amount, so the lower playing surfaces 8 and 9 forming a V-shape may be lifted. Essentially, the lower and upper leg parts 4 and 2 of the support frame 1 are telescopic, therefor the third playing surface 10 may be moved or lifted relative to the floor surface 14 or to the lower playing surfaces 8 and 9, so the open playing field 13 between the playing surfaces 8,9 and 10 is variable between predetermined dimensions. The support frame 1 further comprises adjustment means 12, with the help of which the upper playing field 10 is movable in a direction parallel to the floor surface 14. This movement is of significance during the application of the gameboard.

Use of the gameboard of the invention is described below.

As an introduction it is to be noted that the gameboard of the invention is equally suited for individual play as well as for the concurrent play of more players. The gameboard is adequate for playing a ball game resembling mostly with table tennis. The rules of the game are also based on the rules of traditional table tennis, that is change of serve after every 5 points and one set ends with 21 points. An important difference is though, that with the gameboard of the invention there is no net dividing the playing surface into two halves. It must be noted that a net may also be applied to the gameboard of the invention, but the role and placement of the net is totally different from that of the net used in traditional table tennis. The play is determined by the position of the three playing surfaces 8,9,10 relative to each other. As mentioned above, the board planes constituting the lower playing surfaces 8 and 9 arranged in V-shape are of equal size. The connecting edges of the playing surfaces 8 and 9 are raised 60–75 cm above the floor surface, preferably 68 cm. The surfaces are inclined with respect to the floor surface preferably 27 degrees. The height of the playing surface 10 above the floor surface 14 is between 168–180 cm, preferably 173 cm. The plates of the playing surfaces 8, 9 and 10 are provided with colour markings, e. g. the playing surfaces 8 and 9 are painted green or blue, with white stripes on the sides, and the playing surfaces are divided in four parts with similar white stripes. The lower part of the playing surface 10 is white.

Returning to the use of the gameboard of the invention, the ball must touch each playing surface once in every turn of the game. Thus the player serving the ball hits first with the ball the playing surface in the V-shape further away from him or her, in such a manner, that the ball consequently jumps to the upper playing surface 10, and from there it rebounds to the playing surface in the V-shape closer to him or her, and from there it bounces towards the other player. The other player must than hit the ball in a manner that the ball should again touch all three playing surfaces 8,9 and 10 as described above. The player who is not able to hit the ball back or the ball does not bounce back according to the rules, i.e. the ball does not touch all three playing surfaces, loses the point. The gameboard also may be used by one person only, to develop speed.

The gameboard of the invention offers the following advantages:

provides fast playing rhythm, forces the players to hard exercise, provides good workout for the muscles, improves reflexes, takes little space, and provides varied play.

The gameboard of the invention is not limited to the preferred embodiments illustrated in the drawings and the specification, but may be used for other "games in space" with minor and simple modifications.

List of references 1. support base 2. leg part 3. upper crossbar 4. leg part 5. crossbar 6. braces 7. foot part 8. playing surface 9. playing surface 10. playing surface 11. support element 12. adjustment means 13. playing field 14. floor surface

What is claimed is:

1. An apparatus that is positionable on a floor for playing a game, said apparatus comprising:

(a) first and second lower playing surfaces of substantially equal size;

(b) an upper playing surface; and (c) support means for supporting said apparatus on the floor in a playing configuration with the first and second surfaces disposed in a V-shape, facing away from the floor and toward each other, and inclined at substantially equal angles relative to the floor, and with the upper playing surface disposed substantially parallel to the floor, whereby the first, second and upper surfaces form an open play field with the apparatus supported on the floor in said playing configuration.

2. An apparatus according to claim 1, wherein the support means supports said apparatus on the floor in said configuration with each of the first and second lower playing surfaces inclined with respect to the floor at an angle of 22–32 degrees.

3. An apparatus according to claim 2, that is positioned on the floor in said playing configuration.

4. An apparatus according to claim 1, wherein the support means comprises (i) horizontal foot means for resting the apparatus on the floor;

(ii) a plurality of lower leg parts and a plurality of upper leg parts disposed perpendicular to the foot means, said plurality of lower leg parts being connected to the foot means, and said plurality of upper leg parts being connected to the lower leg parts;

(iii) an upper crossbar connecting said upper leg parts and supporting said upper surface and a lower crossbar connecting said lower leg parts and supporting said first and second lower surfaces, said upper and lower crossbars being parallel to the floor with the support means supporting the apparatus on the floor in said playing configuration.

5. An apparatus according to claim 4, wherein the support means further comprises braces connecting the lower leg parts to the lower crossbar.

6. An apparatus according to claim 4, that is positioned on the floor in said playing configuration.

7. An apparatus according to claim 4 wherein the support means comprises a plurality of support elements, said plurality of support elements connecting the first and second lower playing surfaces to respective of said upper leg parts.

8. An apparatus according to claim 7, that is positioned on the floor in said playing configuration.

9. An apparatus according to claim 4, wherein the first and second lower playing surfaces are fixedly connected to the lower crossbar.

10. An apparatus according to claim 9, that is positioned on the floor in said playing configuration.

11. An apparatus according to claim 1, wherein the support means comprises a support frame, said first and second playing surfaces being foldably attached to the support frame.

12. An apparatus according to claim 11, that is positioned on the floor in said playing configuration.

13. An apparatus according to claim 1, wherein the support means comprises hinge or joint means for adjusting the disposition of the upper and lower playing surfaces relative to one other so as to permit said upper and lower surfaces to be moved into a vertical position relative to the floor whereby to conserve space.

14. An apparatus according to claim 13, that is positioned on the floor in said playing configuration.

15. An apparatus according to claim 1, wherein the support means comprises adjustment means for moving the upper playing surface in a direction parallel to the floor.

16. An apparatus according to claim 15, that is positioned on the floor in said playing configuration.

17. An apparatus according to claim 1, further comprising a net dividing the open play field.

18. An apparatus according to claim 1, wherein the lower playing surfaces are provided with markings.

19. An apparatus according to claim 18, wherein the markings are color markings.

20. An apparatus according to claim 1, that is positioned on the floor in said playing configuration.

21. A method for playing a game comprising the steps of:

(a) providing a gameboard with (i) first and second lower playing surfaces of substantially equal size;

(ii) an upper playing surface; and (iii) a support structure supporting said apparatus on the floor in a playing configuration with the first and second surfaces disposed in a V-shape, facing away from the floor and toward each other, and inclined at substantially equal angles relative to the floor, and with the upper playing surface disposed substantially parallel to the floor, whereby the first, second and upper surfaces form an open play field with the apparatus supported on the floor in said playing configuration;

(b) providing a ball; and (c) hitting the ball from a first side of the gameboard so that the ball (i) first contacts one of the first or second lower playing surfaces, (ii) then contacts the upper playing surface, (iii) then contacts the first or second lower playing surface not contacted in step (c)(i) and (iv) then bounces toward a second side of the gameboard.

* * * * *